US006367113B1

(12) United States Patent
Usui

(10) Patent No.: US 6,367,113 B1
(45) Date of Patent: Apr. 9, 2002

(54) ARTIST PAINTING INSTRUMENT

(76) Inventor: Sam S. Usui, 90 Duncan Dr., Greenwich, CT (US) 06831

( * ) Notice: Subject to any disclaimer, the term of this patent is extended or adjusted under 35 U.S.C. 154(b) by 0 days.

(21) Appl. No.: 09/373,252

(22) Filed: Aug. 12, 1999

(51) Int. Cl.[7] ..... A46B 5/02; A46B 17/02; A46B 15/00

(52) U.S. Cl. ..... 15/176.2; 15/160; 15/143.1; 16/430

(58) Field of Search ..... 15/160, 176.2, 15/176.6, DIG. 4, 143.1; 401/6; D4/132, 135; 16/430

(56) References Cited

U.S. PATENT DOCUMENTS 2,155,004 A * 4/1939 Blossom ..... 15/143.1
3,186,765 A * 6/1965 Gentoso
D204,449 S * 4/1966 Zavodsky ..... 15/143.1
4,471,507 A * 9/1984 Schwartz ..... 15/176.2
5,430,905 A * 7/1995 Curtin ..... 15/106
5,446,941 A * 9/1995 Kelsay ..... 15/143.1
D378,026 S * 2/1997 Balazs ..... D4/135
5,749,117 A * 5/1998 Forslin ..... 15/245.1
6,138,313 A * 10/2000 Barton et al. ..... 15/143.1
D435,349 S * 12/2000 Kim ..... D4/135

* cited by examiner

*Primary Examiner*—Gary K. Graham
(74) *Attorney, Agent, or Firm*—Alfred E. Miller

(57) ABSTRACT

An artist painting brush having a brush head including a ferrule and a brush tuft, a forward barrel having a portion with a reduced cross section, a hollow grip fitting over the part with reduced cross-section. The brush head is fixed to the forward barrel whereby the ferrule brush tuft and forward barrel are replaceable, and a rear barrel having means to be removably connected to the front barrel whereby the cross-section of the combined forward barrel portion and hollow grip is substantially the same as the cross-section of the rear barrel. The ferrule is fabricated of stainless steel in order to avoid the possibility of allergic reaction to an artist handling the painting brush.

7 Claims, 3 Drawing Sheets

ARTIST PAINTING INSTRUMENT

This invention relates to an improvement in artist's painting instruments having a replaceable brush head resulting in economy, as well as being provided with a more comfortable and less fatiguing grip handle for the painting instrument.

BACKGROUND OF THE INVENTION

Cartridge fountain pens are known. For example, U.S. Pat. No. 5,017,035 to Peters et al. shows a cartridge refill pen which is opened and closed by the relative movement of interconnected parts. U.S. Pat. No. 5,785,443 to Rubin shows a writing instrument, which is replaceable and has a bulbous grip. The patent states that the grip ergonomically engages the surfaces of the user's thumb and fingers. The patent frther mentions that the hand held implement can be used for a variety of manual activities.

SUMMARY OF THE INVENTION

It is a feature of the present invention to provide an artists' instrument, such as an artists' brush, in which the ferrule and tuft constituting a brush head at the end of the instrument may be replaced, as needed, by unscrewing the brush head and forward barrel from the rear barrel part of the writing instrument.

It is known that some artists have an allergic reaction to certain ferrules fabricated out of nickel and chrome. Consequently, it is an object of the present invention to provide a non-allergic ferrule of stainless steel.

It is another feature of the present invention to provide the front barrel of an artist instrument having a rearward projecting section of reduced diameter so that a soft flexible tubular grip can be placed over the reduced diameter section whereby the grip section has a larger diameter than the diameter of the known artists paint brushes resulting in less tiresome and easier handling of the artist's instrument.

It is another feature of the present invention to provide an artists' instrument in which the forward and rear barrels are screw connected and have only the gripping part of the instrument covered in a soft yieldable material for both comfort and ease in painting.

In order that the invention may be clearly understood it will now be described in further detail with reference to the accompanying drawings.

DESCRIPTION OF THE PREFERRED EMBODIMENT

Figure 1:
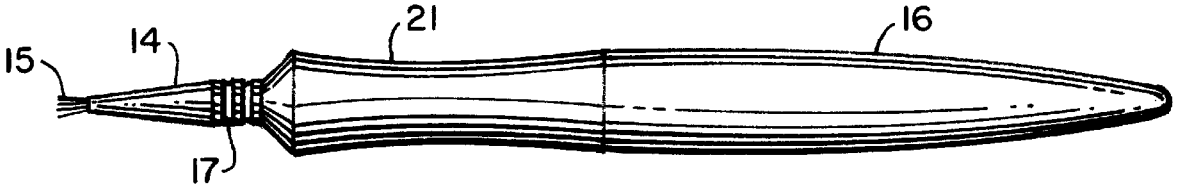
FIG. 1 is a side elevational view of my assembled improved artist brush instrument in accordance with the teachings of the present invention.

Referring now to FIGS. 1–8 of the drawings, the artist brush has a forward barrel 10, which is provided which has a reduced rear cylindrical barrel part 12 referred to generally by the reference numeral 10. At the front end of barrel 10 is a ferrule 14, which is crimped at 17 to the barrel 10. At the forward end of the ferrule is a tuft 15. The preferred composition of the ferrule is stainless steel in order to avoid any possibility of allergic reactions upon use by artists. The rear barrel 16 of the artist brush is provided with a threaded opening 18 at its forward end. The barrel part 12 cylindrical has a reduced diameter, and is provided with a threaded portion 20 which is screw connected into the correspondingly threaded opening 18 of the rear barrel 16.

A soft cylindrical and hollow finger grip 21 of rubber, or the like, is inserted over the barrel part 12 of the forward barrel 10. It should be noted that the cylindrical barrel part 12 is of reduced cross-section, compared to the cross section of the rear barrel.

The soft yieldable finger grip is of such a width for example approximately 13 mm, as to be most comfortable and less fatiguing when painting over a lengthy period. It is preferred to fabricate the forward and rear barrels of the writing instrument of a durable thermoplastic material, such as ABS. The entire artist instrument handle portion has been made wider for ergonomic reasons in order to enhance the control of the artist's brush when it is being used.

Figure 2:
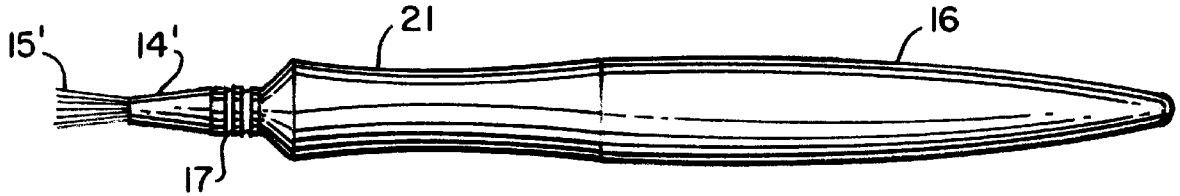
FIG. 2 is a side elevational view of an artist brush with a replacement brush head.
Figure 3:
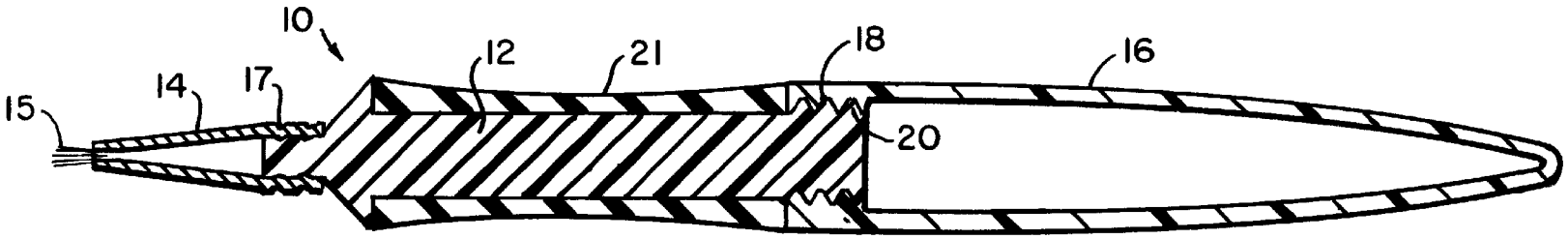
FIG. 3 is a cross-sectional view of an assembled artist brush instrument shown in FIG. 1.
Figure 4:
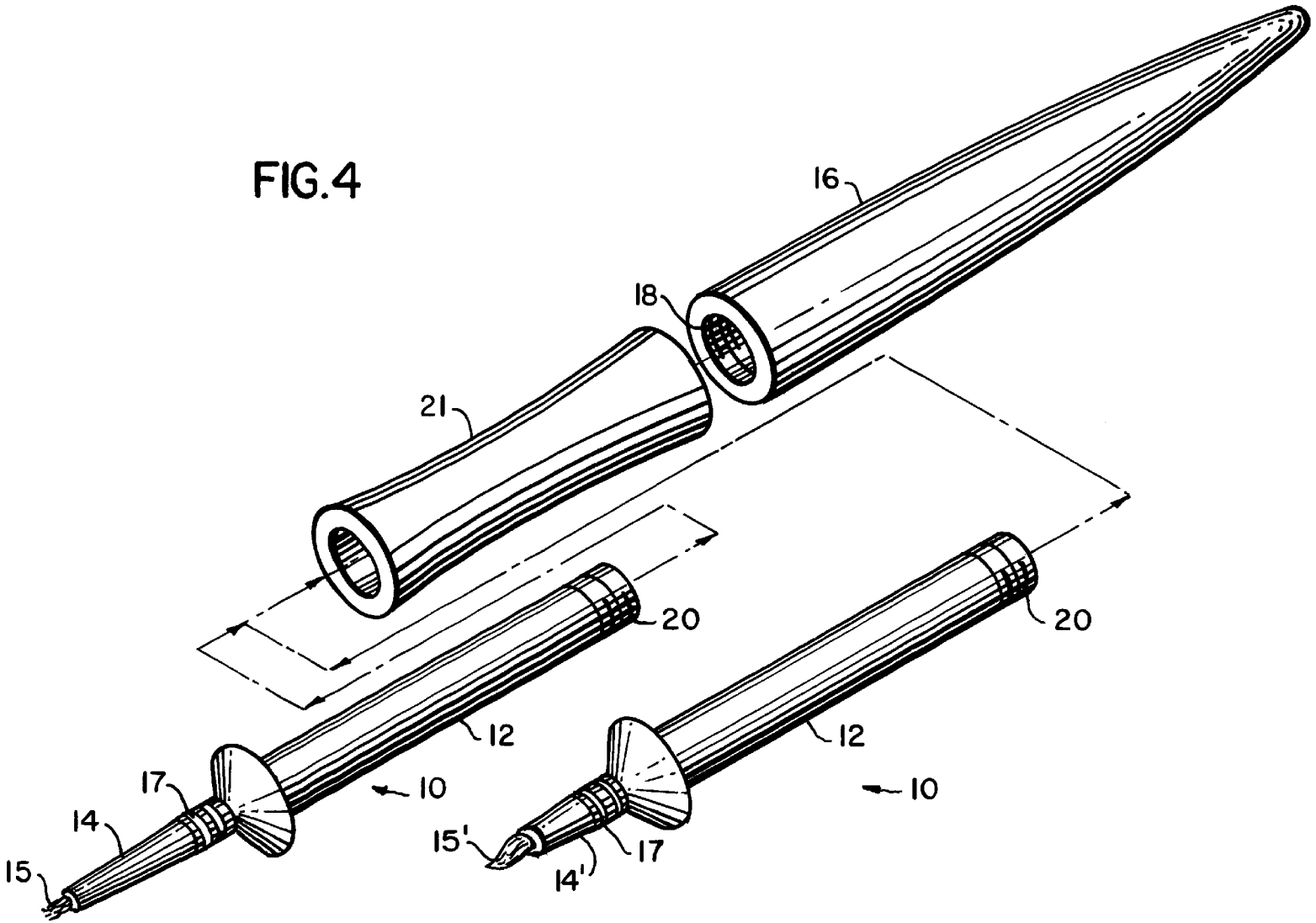
FIG. 4 is an exploded view of an artist brush instrument showing both a brush head and a replacement brush head.
Figure 5:
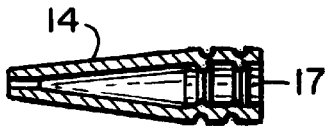
FIG. 5 is a side elevational view of a stainless steel ferrule component of the artist brush shown in FIG. 3.
Figure 6:
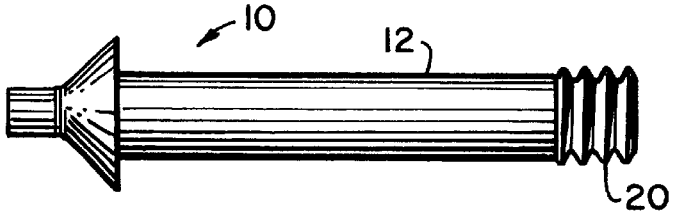
FIG. 6 is a side elevational view of the forward barrel of the artist brush shown in FIG. 3.
Figure 7:
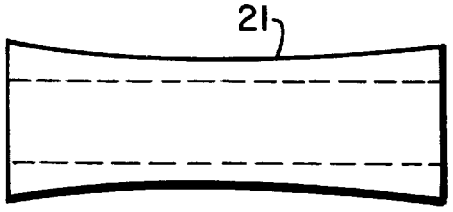
FIG. 7 is a side elevational view of the hollow finger grip.
Figure 8:
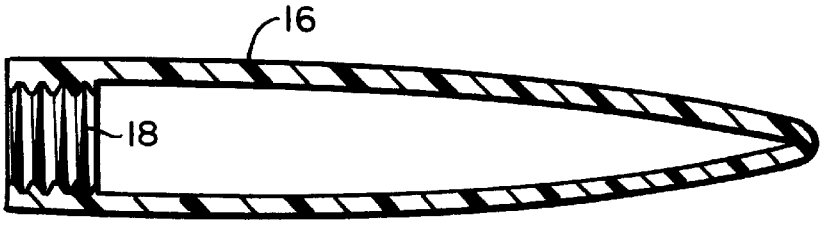
FIG. 8 is a sectional view of the rear barrel of the artist brush instrument and FIG. 9 is a fragmentary view of a stainless steel ferrule utilized in another type of brush, such as a cosmetic or make-up brush.

As seen in FIGS. 1, 2 and 4. The forward barrel 10 with its ferrule 14 and tuft 15 can be replaced with artist brush having a different or the same tuft size, such as ferrule 14' and tuft 15' as seen in FIG. 2, by merely unscrewing the forward barrel 10 from the rear barrel 16 whereby the entire front barrel assembly is replaced, as required.

Figure 9:
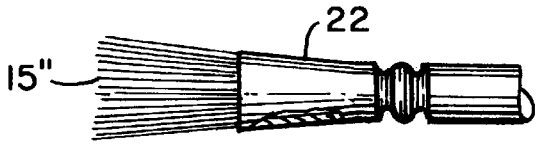

As seen in FIG. 9, a one piece, continuous stainless steel ferrule 22 can be applied to cosmetic or make-up brush with broader and larger tufts 15 " to avoid allergic reactions when applying make-up.

While the present invention has been described and shown with reference to a preferred embodiment it is not to be intended to be limited to the present disclosure, but should cover equivalents in accordance with the spirit and scope of the invention as defined in the following claims.

What is claimed is:

1. An artist painting instrument comprising a brush head including a ferrule having a forward end and a brush tuft at said forward end of said ferrule, a forward barrel and a rear barrel, said forward barrel provided with a front and rear portion and having a reduced cross-section compared to said rear barrel, a soft yieldable hollow grip inserted over the reduced cross-section of said forward barrel, said brush head being attached to said forward barrel whereby the ferrule, brush, tuft and forward barrel are replaceable as a unit, said rear portion of said forward barrel being screw-threaded and said rear barrel having a hollow opening with screw threads adopted to mate with screw threads on the rear portion of said forward barrel for removably interconnecting said forward and rear barrels.

2. An artist painting instrument as claimed in claim 1 wherein the combined diameter of said reduced cross-section of the forward barrel and hollow grip is substantially the same as the diameter of a part of said rear barrel.

3. An artist painting instrument as claimed in claim 1 wherein said grip is fabricated of a silicone rubber.

4. An artist painting instrument as claimed in claim 1 wherein said forward and rear barrels are fabricated of a thermoplastic resin.

5. An artist painting instrument as claimed in claim 4 wherein said thermoplastic resin is ABS.

6. An artist painting instrument as claimed in claim 1 wherein said ferrule is stainless steel.

7. An artist painting instrument as claimed in claim 1 wherein the combined diameter of said reduced cross-section of the forward barrel and said grip is about 13 mm.

* * * * *